US005123777A

United States Patent [19]

Tadros

[11] Patent Number: 5,123,777

[45] Date of Patent: Jun. 23, 1992

[54] CONSTRUCTION ELEMENTS

[75] Inventor: Maher K. Tadros, Omaha, Nebr.

[73] Assignee: The Board of Regents, University of Nebraska, Lincoln, Nebr.

[21] Appl. No.: 519,897

[22] Filed: May 7, 1990

[51] Int. Cl.[5] ..... E01C 5/00; E01C 3/00; A47L 15/00

[52] U.S. Cl. ..... 404/34; 404/27; 14/77.3; 14/73

[58] Field of Search ..... 404/27, 34, 43, 134; 14/6, 13, 73, 75, 77

[56] References Cited

U.S. PATENT DOCUMENTS

| | | | |
|---|---|---|---|
| 3,027,687 | 4/1962 | Baroni | 14/73 |
| 3,296,640 | 1/1967 | Gunn | 14/77 |
| 3,706,125 | 12/1972 | Hopkins | 14/77 |
| 3,906,067 | 9/1975 | Alspach | 404/27 |
| 3,906,571 | 9/1975 | Zetlin | 14/6 |

FOREIGN PATENT DOCUMENTS

| | | | |
|---|---|---|---|
| 387097 | 2/1933 | United Kingdom | 94/4 |

*Primary Examiner*—Terry Lee Melius
*Assistant Examiner*—N. Connolly
*Attorney, Agent, or Firm*—Vincent L. Carney

[57] ABSTRACT

To make a reinforced concrete bridge or culvert 10, flat reinforced concrete plates 14A, 14B serving as longitudinally extending side plates and concrete folded plates 18A, 18B serving as shell-like cross members extending from side plate to side plate are formed and carried to the site. Two substantially flat side plates are mounted on drilled piers, driven piles, or other deep foundation structures at their bottom end and extend substantially vertically upward. The cross members are high moment of inertia per unit of weight, thin structures that are mounted on bottom ledges of the two substantially flat parallel vertical side walls and extend laterally between the two to support filler or other parts of the roadway between the side walls.

5 Claims, 3 Drawing Sheets

CONSTRUCTION ELEMENTS

BACKGROUND OF THE INVENTION

This invention relates to support structures using reinforced concrete.

It is known to use reinforced concrete to provide support for culverts and bridges and the like. In one class of such reinforced concrete supports, vertical reinforced concrete walls extend on either side of a waterway or other passageways. In this class of culverts or bridges, at least one horizontal reinforced concrete top member is supported by the vertical reinforced concrete walls to form a curved top surface that receives loads principally in compression and passes it to the sidewalls. In some constructions, dirt is applied over the top member.

In a prior art construction of this type, the reinforced concrete top member or members is integrally formed at least in part with the vertical side walls. For example, one such support structure is formed substantially as a plurality of inverted U-shaped elements that are laid side-by-side through the waterway to provide a path for a roadway over it, with dirt being applied on top to receive vehicles or the like.

This type of structure has several disadvantages, such as for example: (1) it is necessary to divert the waterway during construction in most instances to place the inverted U side walls properly; (2) it is difficult to transport the large U-shaped members to the location for construction; (3) a substantial weight of concrete is necessary to form the top surface; and (4) under some circumstances, the dirt on top of a culvert or bridge applies excessive extra load to the structure.

SUMMARY OF THE INVENTION

Accordingly, it is an object of this invention to provide a novel reinforced concrete construction.

It is a further object of the invention to provide a novel technique for constructing supports, such as for example, culverts and short-span bridges of reinforced concrete.

It is a further object of the invention to provide a low weight, reinforced, concrete structure able to accommodate dirt or other impact reducing filler materials on its top surface.

It is a still further object of the invention to provide a novel support structure which may be mounted on drilled piers, driven piles, or other deep foundation structures without requiring diversion of waterways or other work directly in the path over which the support structure extends.

It is a further object of this invention to provide construction elements which have lower width and use less reinforced concrete than other construction elements but have the same benefits as the other construction elements.

It is a further object of the invention to provide a novel relatively high moment of inertia support element of reinforced concrete for constructing support structures with less reinforced concrete.

It is a still further object of the invention to provide relatively inexpensive reinforced concrete structural elements which may be manufactured using straight form work to reduce construction.

It is a still further object of the invention to reduce the amount of fill necessary in culverts and short-span bridges which in turn reduces the load placed on the support elements.

It is a still further object of the invention to provide construction elements in which reduced thickness of walls nonetheless provides substantial support.

It is a still further object of the invention to provide a support structure in which the bending loads are reduced and balanced.

It is a still further object of the invention to provide a bridge or culvert and the like in which the width is reduced by substantially vertically extending support members.

It is a further object of the invention to provide a culvert or bridge structure in which retaining walls for filler material also serve as railing or traffic barriers and as supports for high moment of inertia per unit of weight cross members extending from side-to-side.

In accordance with the above and further objects of the invention, reinforced concrete structures are formed of a plurality of component parts. The principal component parts are either flat reinforced concrete plates serving as longitudinally extending side plates and concrete folded plates serving as shell-like cross members extending from side plate to side plate.

In this structure, at least two substantially flat side plates form combined supporting members and retaining walls. They are mounted on drilled piers, driven piles, or other deep foundation structures at their bottom end and extend substantially vertically upwardly. The cross members are folded plates or similar high moment of inertia per unit of weight, thin structures that are mounted on bottom ledges of two substantially flat parallel vertical side walls and extend laterally between the two to support filler or other parts of the roadway between the side walls.

Preferably, a culvert or bridge is made so that the high moment of inertia folded plates are fastened at least at a top portion to the side plates to provide lengthwise lateral support to the high moment of inertia folded plates that balances bending pressure exerted by dirt or other filler on the folded plates while imparting the stress longitudinally to the reinforced concrete along an axis of great strength. Filler such as dirt is applied to the high moment of inertia thin-walled shells which may have a cross section of an inverted U-shaped member or inverted triangular member.

To manufacture the reinforced concrete members, the concrete and reinforcement member are inserted into a flat formwork such as conventionally formed plywood. To form the side walls, the plywood is fastened together to form a flat plate with a ledge along its bottom. The reinforcing bars or tendons are placed in the forms and concrete is poured into it. To form the folded plates, the plywood is formed into a mold having two-right regular parallelopiped shaped cavities meeting at an angle and communicating with each other along an elongated edge.

To assemble the bridge or culvert, the concrete members and driven piles are plant-cast and brought to the site. Minor excavation of the banks of the waterway above the water elevation or the sides of the recessed roadway, if needed, is performed. The drilling is performed for drilled piers, or piles, or other deep foundation structures are driven downward into the sides to a sufficient depth to support the bridge or culvert.

When the drilled piers, driven piles, or other deep foundation structures are in place, the end walls are located and fastened to the tops, preferably with the tops of the drilled piers, driven piles, or other deep foundation structures fitting into a preformed socket in the end walls. The high moment of inertia folded plates or shells are then rested on a bottom ledge of the side walls, fastened near their apex to the side walls, and covered with filler.

As can be understood from the above description, the construction units of this invention have several advantages, such as for example: (1) they reduce the amount of material needed because the support elements are shells which utilize high moments of inertia; (2) it is not necessary to interrupt the waterway to construct the culvert or bridge nor to divert traffic for any extended periods of time; (3) it utilizes straight form work in forming the reinforced concrete side plates or folded plates and thus is relatively inexpensive; (4) the units which are required consist of a plurality of identical units which may be easily preformed and precast in a plant before being brought to the site and assembled; (5) the units are flat or are shells which fit one into the other, and when fitted one into the other; are of convenient size, shape and weight for transporting; (6) relatively little earth work is necessary to reducing costs; (7) concrete members are used for maximum effectiveness such as, for example, the side walls support the cross members, are supported upon piers, provide lateral support for the filler and may even serve as a traffic barrier along the sides of the bridge or roadway; (8) the stress on the end walls, caused by the outward thrust of the filler material, are substantially reduced by the support received from the shells through the connection near their apex to the end walls; (9) the stress on the folded plates or shells, caused by their support of the fill and of their own weight and traffic, is substantially reduced by the offsetting forces caused by their apex connection with the end walls; (10) the height of the shells reduces the weight of filler material; and (11) the loading on the bridge or culvert is reduced with a consequential reduction in the amount of concrete needed.

SUMMARY OF THE DRAWINGS

The above noted and other features of the invention will be better understood from the following detailed description when considered with reference to the accompanying drawings in which.

DETAILED DESCRIPTION

Figure 1:
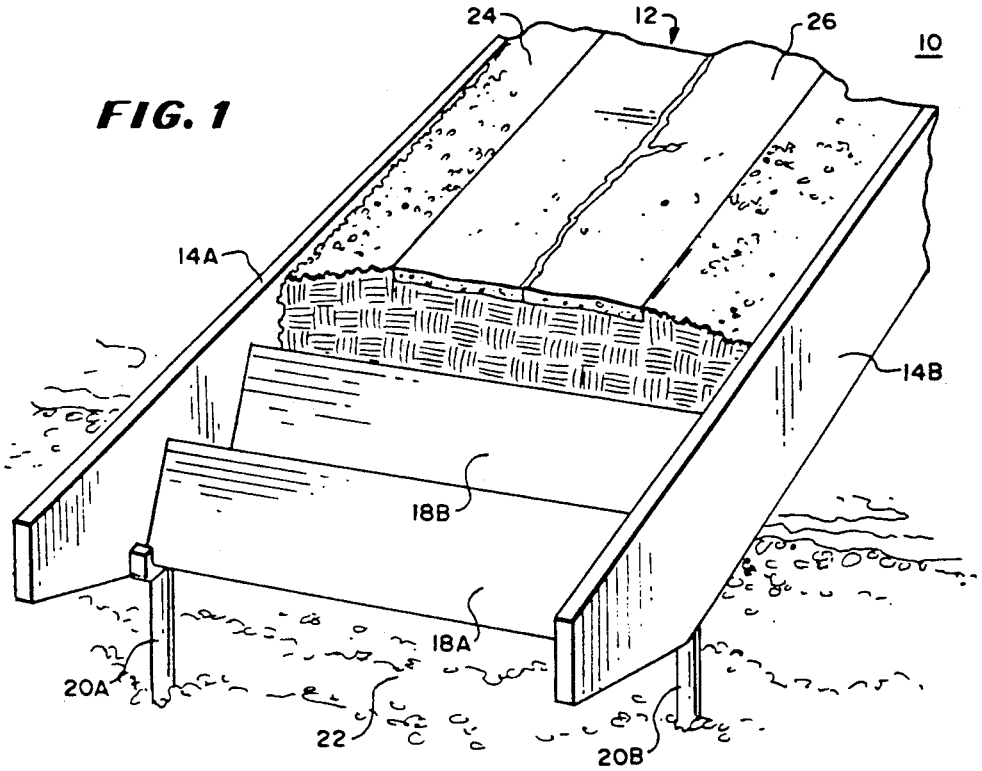
FIG. 1 is a perspective view partly broken away of a culvert constructed in accordance with an embodiment of the invention.

In FIG. 1, there is shown a perspective view, partly broken away of a culvert 10 having a roadway and filled portion 12, first and second side members 14A and 14B, and a plurality of shell members 18A and 18B. The side members 14A and 14B are mounted to driven piling such as that shown at 20A and 20B driven into the sides of a river bank or road such as that shown at 22 passing underneath the culvert or bridge. The shell members 18A and 18B are mounted to the side plates of 14A and 14B and fill material 24 is loaded on top of the shell members. A roadway 26 passes over the fill so that traffic may drive over the roadway 26 to pass over the stream of water or road.

With this arrangement, the culvert or bridge 10 may be assembled by driving piles in a lightly excavated portion of the banks of a stream or the sides of a recessed road and mounting the side plates 14A and 14B directly to the piles without interfering or redirecting the flow of water or interrupting traffic except for safety reasons while overhead construction is taking place. The end plates have ledges that receive the preformed shells such as 18A and 18B side by side across the entire length of the bridge with each shell extending from side plate 14A to side plate 14B. The filler and a roadway may be located on these plates. The side plates 14A and 14B and the shells 18A and 18B are made of reinforced concrete and in some embodiments prestressed reinforced concrete. They are prepared at a central site and moved to the location for the culvert or the bridge.

More specifically, the two vertical side plates 14A and 14B have large parallel vertical surfaces and a bottom edge that extends from the surfaces a sufficient distance to receive a plurality of sideby-side shell elements, two of which are shown at 18A and 18B, extending laterally between the two vertical side plates 14A and 14B. In the preferred embodiment, the shell elements 18A and 18B are perpendicular to the two side plates 14A and 14B and are folded plates. In their downwardly facing bottom edge, the vertical side plates 14A and 14B preferably have sockets of such a size as to receive the tops of drilled piers, driven piles, or other deep foundation structures that support the vertical side walls.

With this arrangement, the side walls are supported along the sides of the road or stream that passes under the structure and the cross members are supported on the side walls so that they need not extend downwardly into the path which may be the flow path of a waterway or road bed, but instead is supported from piers or piles on either side of the flow path of the waterway or a road.

The shell elements are supported on the bottom ledge of the side plates 14A and 14B and fastened at their apex to locations on the sidewalls to hold the sidewalls together against outward pressure from a filler material. The shells are located side to side so as to form a continuous upper surface which can support dirt or other material that freely flows and reduces impact. In the preferred embodiment, this layer of filler material 24 should extend to a level at least one or two feet above the apexes of the shells. The side walls may extend above the surface to provide traffic barriers or supports along the side of a roadway or the like. Preferably, the shell elements 18A, 18B are reinforced concrete folded plates that have a cross section of a triangle with the apex pointing upwardly.

The concrete may be reinforced concrete to provide improved tension strength in a conventional manner. The bottom edge of the sidewalls includes a ledge of sufficient size to support the shell elements and having a sufficient size in the bottom to receive the drilled piers, driven piles, or other deep foundation structures. The sidewalls extend into the banks of the waterway or into the sides of a recessed roadway where they are supported by the drilled piers, driven piles, or other deep foundation structures.

The end walls extend substantially vertically but may be angled vertically away from the center between the bridge or culvert at angles of between plus or minus 15 degrees from the vertical. The spaces between the tops of the drilled piers, driven piles, or other deep foundation structures are filled in a conventional manner such as by blocking the bottom and applying filler material such as nonshrinkable grout through a preformed hole in the top.

With the side plates in place parallel to each other and having their lower bottom ledges facing each other, the shells are positioned across the plates extending from side to side and resting on the ledges. Temporarily, before the shells are in place, the side plates may be supported at their top by another beam or any other means such as by applying dirt from a small excavation around their outer surfaces or by guy cables anchored to the unexcavated ground. The shells are fastened to the sides of the side plates at a location near the top. This may be done by fastening matching pre-embedded fasteners in the shells and in the side plates together.

To reduce the amount of bending of the side walls caused by the fluid filler pushing outwardly in response to vertical force at the top of the filler, the side plate is fastened to the shell at a location in the middle 80 percent of the vertical distance of the side plate that supports the fluid filler. To reduce the weight of the filler which must be supported by the shells, the shells should have a height as close as possible to the top of the roadway to provide as much vacant space between the clearance height and the top of the roadway as possible but should provide for at least one foot of filler material on top of the shell and preferably two feet of filler material to reduce impact forces from automobiles or the like passing over the top.

The distance from the bottom of the shell which is on top of the ledge slightly above the clearance point to the top of the shell which is closest to the roadway is related to the span of the culvert or bridge and must be at least three feet. The height should be at least the span divided by ten and typically would be the span divided by six. However, the height should extend as close to the top of the roadway as possible while permitting sufficient filler material to reduce impact forces. Preferably, the angle of the folded plates should be 90 degrees but may be anywhere between 45 and 135 degrees. Thus, the distance between bottoms of the triangular sides of a cross section is in the range between 2 multiplied by the tangent of 67.5 degrees multiplied by the height of the shell and 2 multiplied by the tangent of 22.5 degrees multiplied by the height.

The filler may now be applied over the shells using conventional techniques. To ensure drainage, it may be necessary to use tiling or gravel or other suitable drainage material at the bottom of the filler. The roadway is built up with filler material and then surfaced in a conventional manner with asphalt or concrete or the like.

Figure 2:
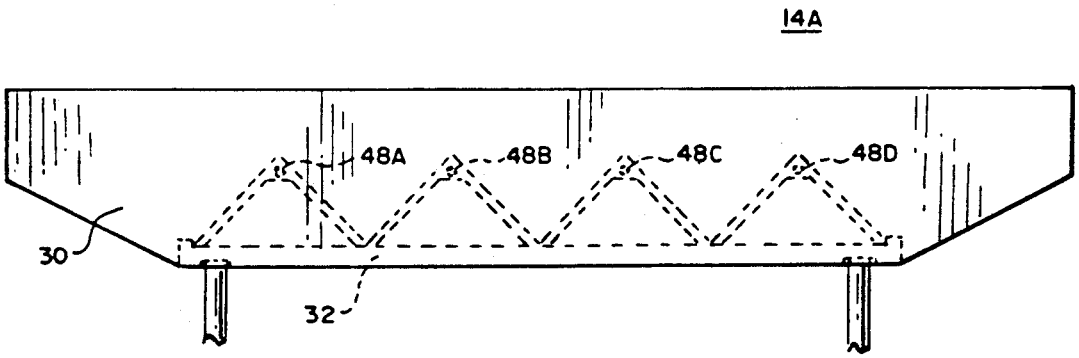
FIG. 2 is a side elevational view of an end plate used in an embodiment of the invention.

In FIG. 2, there is shown a side elevational view of the side plate 14A from the side which faces its opposite parallel side plate 14B (FIG. 1) having a flat upward retaining wall section 30 with a bottom ledge 32. The dimensions of the end wall 14A are chosen to accommodate the nature of the culvert or the bridge. Thus, it is sufficiently long to extend entirely across a stream of water or roadway or the like and is sufficiently high to accommodate enough fill to reduce impact forces from vehicles passing over the culvert or bridge. In one embodiment, the length is 25 feet, the height is 12 feet and the ledge 32 has a height of approximately 1 foot 6 inches. The rear side of the plate 14A is, of course, the same as the front elevation except that there is no ledge 32 so that it is a substantially flat vertical wall. The side walls should be within a range of eight to eighteen inches in thickness and preferably twelve inches.

Figure 3:
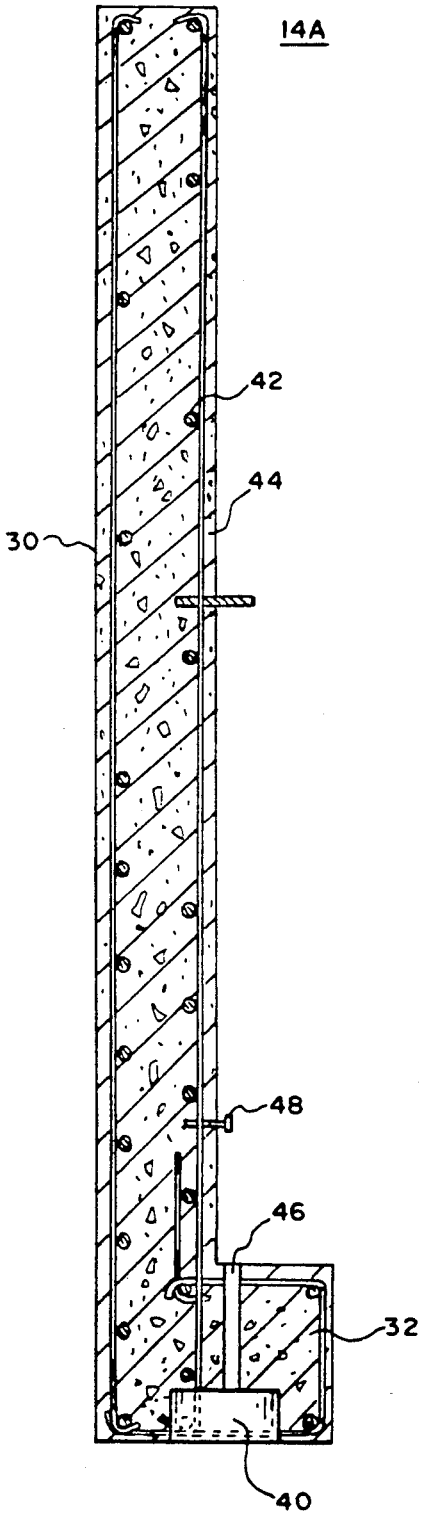
FIG. 3 is a front elevational view of a side plate in accordance with an embodiment of the invention.

As shown in FIG. 3, the ledge 32 extends outwardly at least 5 inches and in the preferred embodiment approximately the same distance as the width of the retaining portion of 30 and includes a socket member 40 adapted to receive the top of a driven pile or drilled pier and including within it reinforcing rods such as those shown at 42 and stress tendons such as those shown at 44. However, it has relatively straight sides so as to be capable of being manufactured using simple flat plywood forms and can be constructed in accordance with known techniques for reinforced concrete and prestressed concrete if desired.

The reinforcement of the sidewalls generally consists of vertical (as the end plate is used in practice) reinforcing bars and horizontally extending reinforced tendon elements or reinforcing bars.

In some embodiments, there is a grouting opening 46 from the top of the ledge 32 extending into the post recess 40 for the purpose of inserting grouting after the end member is mounted to a pile or pier. A closure is temporarily formed around the pile or pier adjacent to the bottom side of the end member to hold the grouting in place until it hardens.

Figure 4:
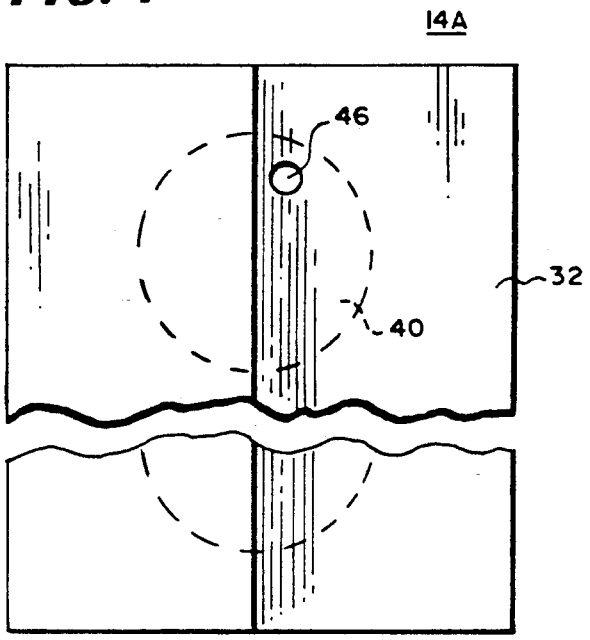
FIG. 4 is a fragmentary top view of a side plate in accordance with an embodiment of the invention.
Figure 5:
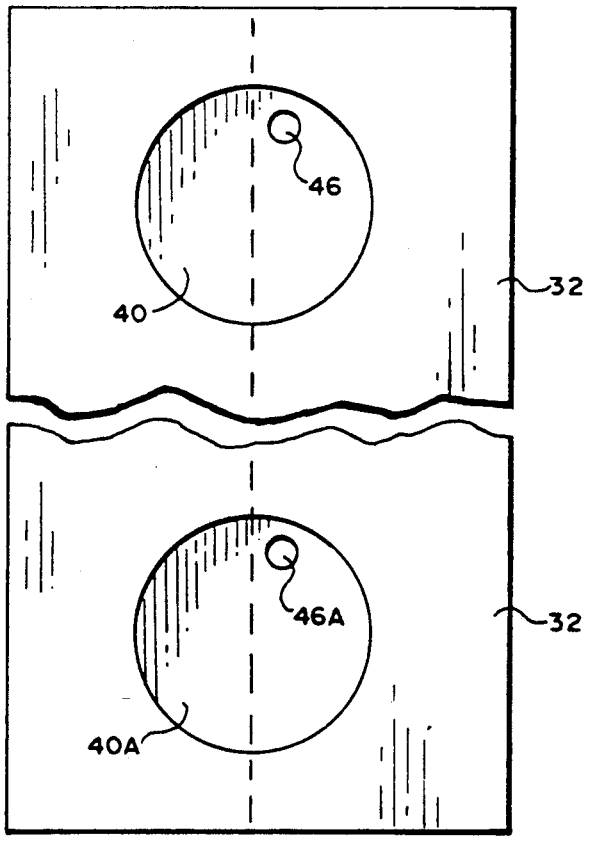
FIG. 5 is a bottom view of a side plate which is an embodiment of the invention.

In FIGS. 4 and 5, there are shown a fragmentary top view and a fragmentary bottom view of the side member 14A showing the ledge 32 and the opening 46 through which grouting can be poured into the opening 40 to seal the pier or piling and thus support the end member.

As best shown FIGS. 4 and 5, at the other end of the side member 14A, there is a similar opening for a post or pier so that each of two side members can be located on a different side of a stream or roadway facing each identical side member and form the principal bottom support of the bridge or culvert. The bottom of the side member 14A thus provides for clearance underneath the culvert or bridge between the culvert or bridge and the flow of water or the roadway adequate for the circumstance. In FIG. 5, there is shown a bottom view of the end member 14A similarly showing the openings 40 and 40A with openings 46 and 46A extending therethrough to receive the pilings or piers.

Figure 6:
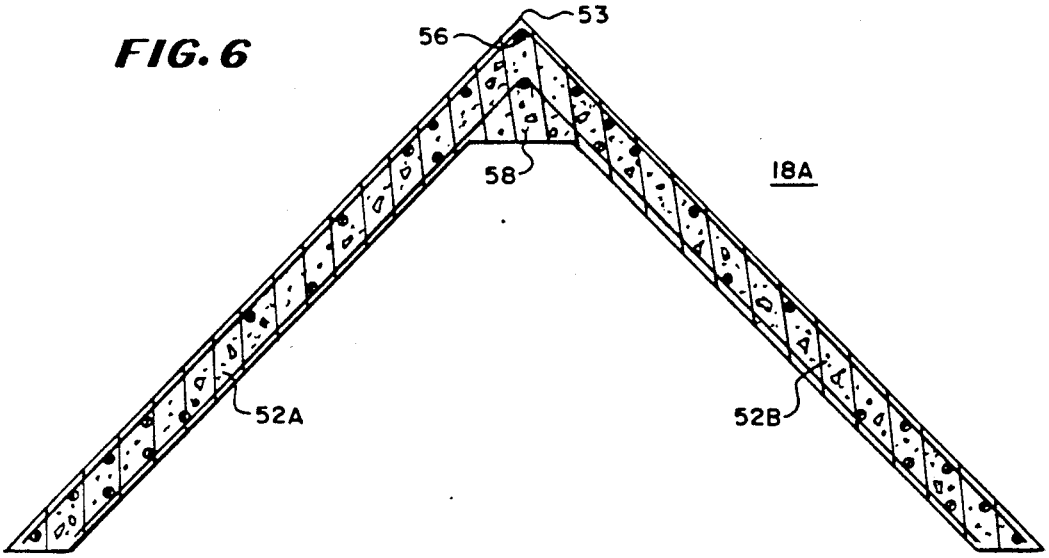
FIG. 6 is a front view of the shell member in accordance with the invention.

In FIG. 6, there is shown a front elevational view of a shell member 18A, which is in the form of a folded plate having a first side member 52A and a second side member 52B joined at an apex 53 where they form right angles with each other. The height of the apex of the triangular cross section from the apex to its base in the preferred embodiment is six feet and its thickness is six inches to form substantial empty space within the folded form.

The folded form is manufactured by precasting with reinforcements using flat plywood forms and providing at the apex connectors 56 at each end for connection to corresponding connectors at 48A (FIGS. 2 and 3) positioned to reduce the amount of bending or deflection of the end plates from pressure caused by the movement of land at an angle to the downward pressure from traffic on the culvert or bridge. The same connectors help reduce the downward deflection and corresponding stresses in the shell members.

The reinforcement utilized for the folded plates or other shell elements are horizontally extending reinforced tendons or reinforcing bars and downwardly extending reinforcing bars. The shell elements may also have relatively thin support elements 64 extending horizontally between the two sloping sides to provide compressional strength against the filler or the like applying forces to the sides and tension strength for forces applied to the apex which might cause the two sides to tend to spread.

These reinforcing members do not normally occupy more than 10 percent of the space between the wall surfaces. These support elements must have sufficient strength both in compression and in tension to help maintain the shape of the walls of the shell element under the forces that will be imparted to them in use. The thickness of the walls falls within a range of four to twelve inches, but preferably is about six inches.

Figure 7:
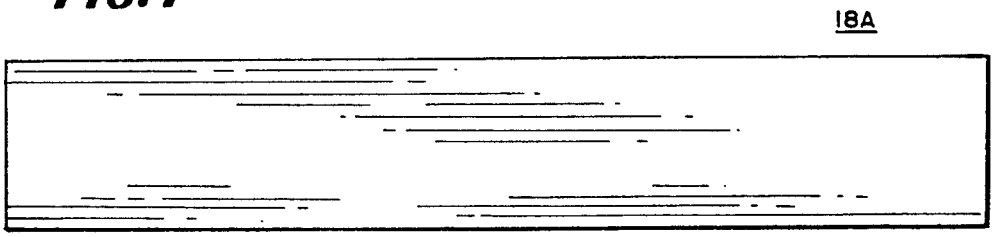
FIG. 7 is a side elevational view of a shell member in accordance with an embodiment of the invention.

Along the center of the sides 52A and 52B are reinforcements such as the one shown at 58 extending between the two to provide support against bending against the downward weight on the sides of the earth and against spreading apart because of the downward weight at the apex of the triangular cross section folded plate. In FIG. 7, there is shown a side elevational view of the shell 18A sized to extend from side wall to end wall for 36 feet across or for whatever distance is required by the roadway width requirements.

Figure 8:
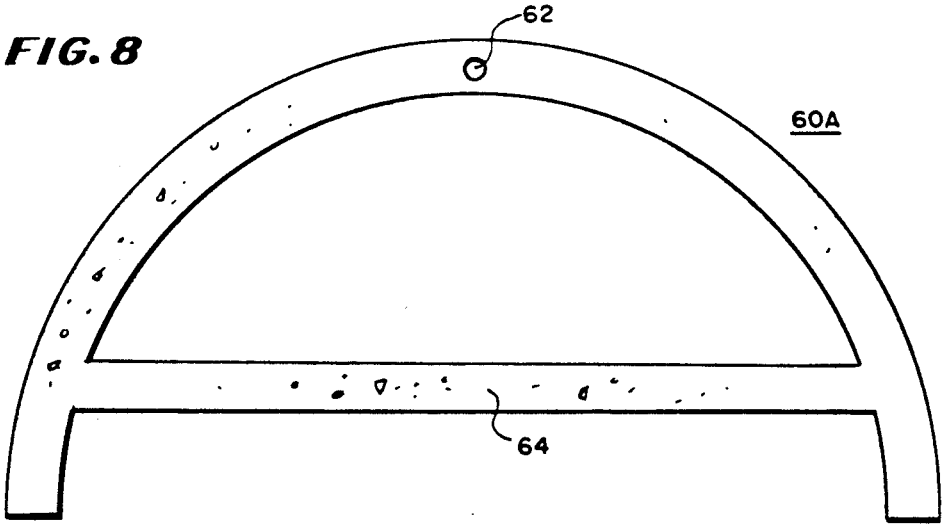
FIG. 8 is a front view of another embodiment of shell member.

In FIG. 8, there is shown an end view of a shell 60A which may be used instead of the shell at 18A. It has the same length and height but instead of being a folded plate having a cross section of a triangle it is an arc having a curvelinear cross section such as for example a circle. It is utilized in the same manner as a shell having the cross section of a triangle having a means of 62 for attachment to an end wall and central supporting reinforcement 64.

In manufacturing the bridges or culverts, the reinforced concrete shells and the end plates are manufactured at a central location and taken to a location for installation. A small amount of excavation may be needed and piles are driven into the ground or piers are drilled and inserted. The end plates are located in place with the piers fitting within the bottom sockets and the shells are positioned over the ledges of the end plates and connected together. After this, earth is applied and the road surface provided.

To manufacture the shells and end plates, conventional forms are connected, reinforcing rods and reinforced tendons are located in place. The connecting reinforcements internal to the shell and the connecting reinforcements for connection between the shells and the end plates are placed in the proper location and the concrete is poured. It may be reinforced in some configurations as needed.

To move the end plates and shells to the location for use, they can be placed on the bed of a truck, with the end plates lying flat and the shells one within the other for compact transportation. They may be unloaded at the site for quick assembly.

At the site, minor excavation may be made for the placement of the sidewalls on the banks of the waterway or the sides of the recessed roadway. Thus, the site work or dirt work is reduced to a minimum. Moreover, it is not necessary to divert the flow of a waterway or, except for safety purposes, to interrupt the flow of traffic along a recessed roadway, although under some circumstances none is needed. The piles are driven in a manner known in the art or the piers drilled in place on both sides of the flowing stream or road to be covered. The piers may be located either at an angle or directly across as desired.

To assemble the bridge, the end plates are lifted and moved on top of the piers so that the tops of the drilled piers, driven piles, or other deep foundation structures fit within the appropriate sockets. The two end plates may be held together by a clamp, if desired, but in some circumstances, will remain in place without such a clamp. The shells are then assembled with their sides touching each other across the length of the bridge or culvert. The ends of the shells extend into and rest on the ledges 30 (FIG. 2) of the end plates and their connectors 62 (FIG. 8) are connected to the connectors 48 (FIGS. 2 and 3) of the end plates so that bowing of the end plates will be reduced and the force that would normally cause bowing results in tension along the strong axis of the shells.

With the shells in place extending across the length of the bridge, in some configurations, a fabric may be located to reduce erosion of soil into the river bed or road without preventing drainage. Earth is then located on top of the shells for a foot or two feet according to the design and the road bed replaced on top of the culvert or bridge. The excavated material is then packed around the ends near the pier to form a completed culvert or bridge.

As can be understood from the above description, the construction units of this invention have several advantages, such as for example: (1) they reduce the amount of material needed because the support elements are shells which utilize high moments of inertia per unit of weight; (2) it is not necessary to interrupt the waterway to construct the culvert or bridge nor to divert traffic for any extended periods of time; (3) it utilizes straight form work in forming the reinforced concrete side plates or folded plates and thus is relatively inexpensive; (4) the units which are required consist of a plurality of identical units which may be easily preformed and precast in a plant before being brought to the site and assembled; (5) the units are flat or are shells which fit one into the other, and when fitted one into the other, are of convenient size, shape and weight for transporting; (6) relatively little earth work is necessary to assemble the culvert or the bridge thus reducing costs; (7) concrete members are used for maximum effectiveness such as for example the side walls support the cross members, are supported upon piers, provide lateral support for the filler and may even serve as a traffic barrier along the sides of the bridge or roadway; (8) the stresses on the end walls, caused by the outward thrust of the filler material, are substantially reduced by the support received from the shells through the connection near their apex to the end walls; (9) the stress on the folded plates or shells, caused by their support of the fill and of their own weight and traffic, is substantially reduced by the offsetting forces caused by their apex connection with the end walls; (10) the height of the shells reduces the weight of filler material; and (11) the loading on the bridge or culvert is reduced with a consequential reduction in the amount of concrete needed.

Although a preferred embodiment of the invention has been described with some particularity, many variations and modifications of the preferred embodiment may be made without deviating from the invention. Therefore, it is to be understood that, within the scope of the appended claims, the invention may be practiced other than as specifically described.

What is claimed is:

1. A concrete structure comprising:

first support means with first and second side plate means adapted to be supported by second support means and to extend across an opening;

concrete shell means connecting said first and second side plate means;

said concrete shell means being positioned side by side and having their ends connected to different ones of the first and second side plate means whereby a continuous surface is formed, adapted to receive soil;

the first and second side plate means each including parallel flat sides adapted to be positioned substantially vertical to serve as a retaining wall and including bottom ledges adapted to support the concrete shell means;

said ledge of said first side plate means and said ledge of said second side plate means extending near the bottom of said side plate means into the region between said first and second side plate means;

said first and second side plate means having parallel flat sides and a thickness from parallel flat side to parallel flat side in a range of 8 to 18 inches;

said first and second side plate means including apertures in their bottom adapted to receive said second support means;

said second support means being elongated members that extend downwardly at least five feet;

said concrete shell means being folded plates;

said concrete shell means resting upon said ledges;

said concrete structure further including a plurality of connector means each of said connector means connecting one of said side plate means to one of said concrete shell means at a location on said one side plate and an adjacent end of said one concrete shell means above said ledges, whereby bending forces exerted by filler material on said side plate means is resisted by tension force within at least some of said concrete shell means;

at least certain of said concrete shell means being connected at one side to one of said side plates by one of said connector means and being connected at the other side to the other of said side plates by another of said connector means.

2. A concrete structure according to claim 1 in which said structure crosses a span over a passageway beneath it, the height of said concrete shell means shell being at least the length of the span divided by 10.

3. A method of constructing a concrete structure comprising the steps of:

forming reinforced concrete shells;

forming two relatively flat side plates having means for connecting to the concrete shells;

mounting said side plates on support means;

mounting said concrete shells on said side plates;

the step of forming two relatively flat side plates including the steps of forming relatively flat side plates adapted to be vertically mounted and having thickened bottom ledges, whereby the side plates may be mounted as retaining walls on top of said support means that support said concrete shells on said bottom ledge.

4. A method in accordance with claim 3 further comprising the steps of:

mounting said shells with one end on the ledge of said first side plate and the other end of the shell on the ledge of said second side plate wherein said shells are side by side to form a continuous surface;

applying filler on top of said continuous surface.

5. A method of constructing a concrete structure comprising the steps of:

forming reinforced concrete shells;

forming two relatively flat side plates having means for connecting to the concrete shells;

packing the relatively flat side plates on the bed of a truck and the reinforced concrete shells on the truck and taking them to the site for assembly;

the step of packing the reinforced concrete shells including the step of packing reinforced concrete shells having walls with a thickness in the range of four to twelve includes one inside the other, whereby the reinforced concrete shells may be compactly stacked on the bed of the truck;

mounting said relatively flat side plates on support means; and mounting said reinforced concrete shells on said relatively flat side plates.

* * * * *